US011135484B2

(12) United States Patent
Kitagawa

(10) Patent No.: US 11,135,484 B2
(45) Date of Patent: Oct. 5, 2021

(54) GOLF CLUB HEAD

(71) Applicant: BRIDGESTONE SPORTS CO., LTD., Tokyo (JP)

(72) Inventor: Tomonori Kitagawa, Tokyo (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 0 days.

(21) Appl. No.: 16/665,475

(22) Filed: Oct. 28, 2019

(65) Prior Publication Data

US 2020/0188743 A1 Jun. 18, 2020

(30) Foreign Application Priority Data

Dec. 13, 2018 (JP) ..... JP2018-233650

(51) Int. Cl.
*A63B 53/04* (2015.01)

(52) U.S. Cl.
CPC ..... *A63B 53/0466* (2013.01); *A63B 53/0433* (2020.08)

(58) Field of Classification Search
CPC ..... A63B 53/06; A63B 2053/0454; A63B 2053/0433
USPC ..... 473/329, 338, 346, 350
See application file for complete search history.

(56) References Cited

U.S. PATENT DOCUMENTS

| | | | | |
|---|---|---|---|---|
| 7,575,523 | B2 | 8/2009 | Yokota | |
| 7,588,502 | B2 | 9/2009 | Nishino | |
| 8,608,585 | B2 | 12/2013 | Stites et al. | |
| 9,901,793 | B2 | 2/2018 | Ban et al. | |
| 2010/0273565 | A1* | 10/2010 | Stites | A63B 53/0466 473/282 |
| 2015/0360099 | A1* | 12/2015 | Ban | A63B 53/0466 473/334 |
| 2017/0014691 | A1* | 1/2017 | Takechi | A63B 53/0466 |
| 2018/0028883 | A1* | 2/2018 | Morin | A63B 53/047 |

FOREIGN PATENT DOCUMENTS

| | | | |
|---|---|---|---|
| JP | 4608426 | B2 | 1/2011 |
| JP | 4608437 | B2 | 1/2011 |
| JP | 5542914 | B2 | 7/2014 |
| JP | 2016-158915 | A | 9/2016 |
| JP | 2017-023216 | A | 2/2017 |
| JP | 6363406 | B2 | 7/2018 |

* cited by examiner

*Primary Examiner* — Raeann Gorden

(74) *Attorney, Agent, or Firm* — Sughrue Mion, PLLC

(57) ABSTRACT

A golf club head that includes a face portion, an abutment member which abuts against a back surface of the face portion, and a fixing portion which is provided at a position separated from the back surface of the face portion and to which the abutment member is fixed. The abutment member includes a non-metal distal end portion which abuts against the back surface of the face portion, and a metal body portion which is fixed to the face portion. The body portion including a convex engaging portion provided in an end portion of the body portion. The distal end portion including a concave engaging portion which engages with the convex engaging portion.

5 Claims, 4 Drawing Sheets

GOLF CLUB HEAD

CROSS-REFERENCE TO RELATED APPLICATION(S)

This application claims priority to and the benefit of Japanese Patent Application No. 2018-233650 filed on Dec. 13, 2018, the entire disclosure of which is incorporated herein by reference.

BACKGROUND OF THE INVENTION

Field of the Invention

The present invention relates to a golf club head.

Description of the Related Art

There have been proposed golf club heads each provided with a reinforcement structure or adjustment structure on the back surface of the face portion for reinforcement of the face portion or adjustment of the rigidity distribution thereof (for example, Japanese Patent Laid-Open Nos. 2017-23216 and 2016-158915, and Japanese Patent Nos. 6363406, 5542914, 4608437, and 4608426). Among these, Japanese Patent Laid-Open No. 2017-23216 discloses a golf club head provided with an abutment member that abuts against the back surface of the face portion.

At the time of striking a golf ball, an impact acts on the face portion and the face portion bends. If the abutment member that abuts against the back surface of the face portion is made of only a metal material, it may suppress the bending of the face portion too much. On the other hand, if the abutment member is made of only a non-metal material such as resin, the strength may be insufficient. Therefore, it is conceivable that the abutment member is formed by two members, a metal member and a non-metal member. However, a stress tends to concentrate on the coupling portion between the non-metal member and the metal member, and the breakage of the coupling portion due to the pact at the time of striking a ball should be avoided.

SUMMARY OF THE INVENTION

The present invention provides, when the abutment member that abuts against the back surface of the face portion is formed by two members, a metal member and a non-metal member, a structure capable of preventing the breakage of the coupling portion between the two members.

According to an aspect of the present invention, there is provided a golf club head that includes a face portion, comprising: an abutment member which abuts against a back surface of the face portion; and a fixing portion which is provided at a position separated from the back surface of the face portion and to which the abutment member is fixed, the abutment member including; a non-metal distal end portion which abuts against the back surface of the face portion; and a metal body portion which is fixed to the face portion, the body portion including a convex engaging portion provided in an end portion of the body portion, and the distal end portion including a concave engaging portion which engages with the convex engaging portion.

Further features of the present invention will become apparent from the following description of exemplary embodiments (with reference to the attached drawings).

DESCRIPTION OF THE EMBODIMENTS

Figure 1A:
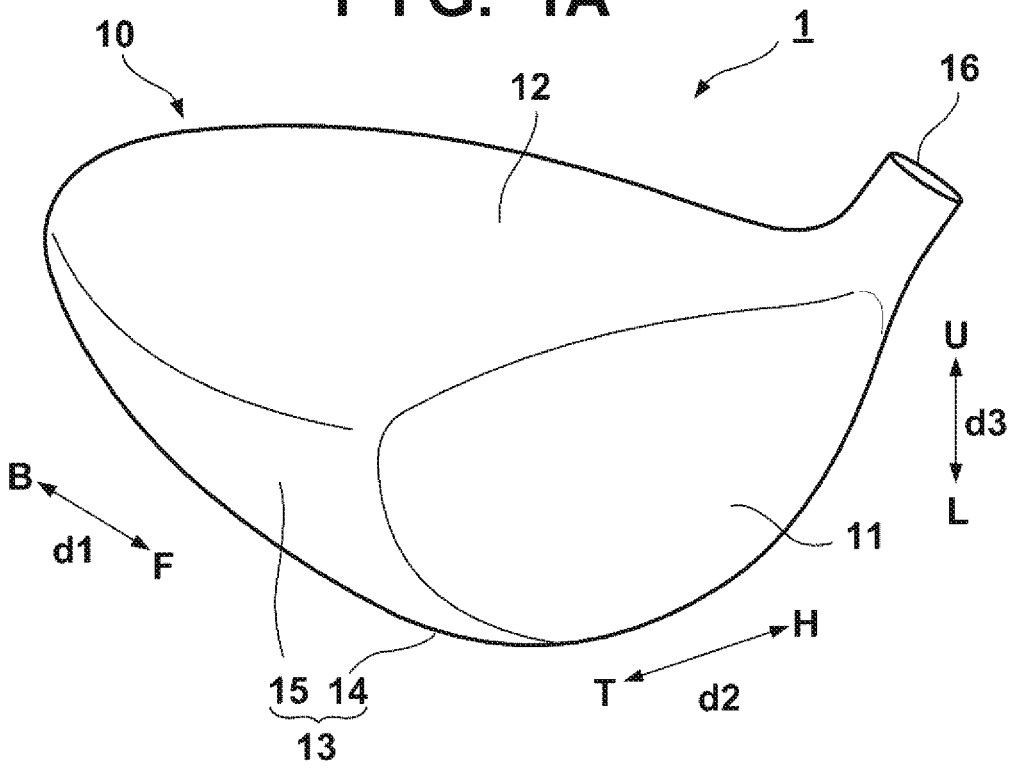
FIG. 1A is a perspective view of a golf club head according to an embodiment of the present invention.
Figure 1B:
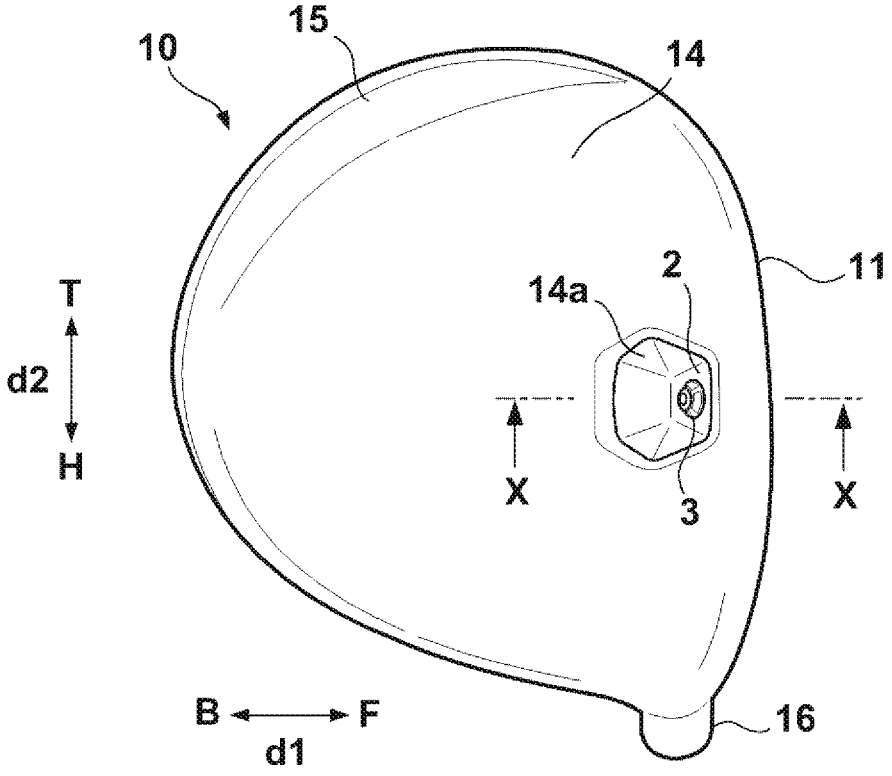
FIG. 1B is a view showing the golf club head in FIG. 1A when viewed from the sole portion side.

FIG. 1A is a perspective view of a golf club head 1 according to an embodiment of the present invention, and FIG. 1B is a view showing the golf club head 1 when viewed from the side of a sole portion 14.

The golf club head 1 includes a hollow member 10 forming its body, and the peripheral walls of the hollow member 10 form a face portion 11, a crown portion 12, and a sole/side portion 13. The sole/side portion 13 includes the sole portion 14 and a side portion 15. The surface (front surface) of the face portion 11 forms a face surface (striking surface). A bulge and a roll can be formed on the face surface. The crown portion 12 forms the upper portion of the golf club head 1. The sole portion 14 forms the bottom portion of the golf club head 1. The side portion 15 forms the portion between the sole portion 14 and the crown portion 12. The golf club head 1 also includes a hosel portion 16 into which a shaft is inserted.

In FIG. 1A, an arrow d1 indicates a face-back direction, and reference symbols F and B indicate the side of the face portion and the back side, respectively. An arrow d2 indicates a toe-heel direction, and reference symbols T and H indicate the toe side and the heel side, respectively. An arrow d3 indicates a vertical direction (crown-sole direction), and reference symbols U and L indicate the upper side (crown side) and the lower side (sole side), respectively. The face-back direction is, for example, a target line direction (the target direction of a shot). The toe-heel direction is, for example, a direction in which the toe-side end and the heel-side end of the sole portion 14 are coupled and has an approximately orthogonal relationship to the target line direction. The vertical direction is the perpendicular direction obtained when the golf club head 1 is set on a horizontal plane in accordance with a predetermined lie angle and a predetermined loft angle, and the vertical direction has an orthogonal relationship to the directions indicated by the arrows d1 and d2.

The golf club head 1 is a golf club head for a driver. However, the present invention is applicable to other types of golf club heads, such as wood-type golf club heads including those for fairway woods other than those of drivers, and iron-type golf club heads.

The golf club head 1 can be formed from a metal material, and examples of the metal material are a titanium-based metal (for example, titanium alloy 6Al-4V—Ti), stainless steel, an aluminum alloy, and a copper alloy such as beryllium copper.

The golf club head 1 can be assembled by joining a plurality of parts. For example, it can be formed by the head body member, the face member, and the cover member. The head body member forms the sole portion 14 and the side portion 15. In the head body member, an opening portion (face opening portion) corresponding to the face portion 11 and an opening portion (crown opening portion) corresponding to the crown portion 12 are formed. The face member is joined to the face opening portion of the head body member to close the opening portion, thereby forming the face portion 11. The cover member is joined to the crown opening portion of the head body member to close the opening portion, thereby forming the crown portion 12.

A concave portion 14*a* is provided in the sole portion 14, and a fixing portion 2 is formed on the wall of the concave portion 14*a* on the face portion 11 side. The fixing portion 2 is provided at a position separated from the face portion 11 in the d1 direction, and fixes an abutment member 3 to the hollow member 10. In other words, the fixing portion 2 is a mounting portion of the abutment member 3. In this embodiment, the fixing portion 2 is located in the central portion in the d2 direction, but it may be located on the toe side or may be located on the heel side. In addition, in this embodiment, the fixing portion 2 is located on the face portion 11 side in the d1 direction, but it may be located on the back side. Note that the fixing portion 2 may be provided in the side portion 15 or the crown portion 12. Moreover, in this embodiment, one set of the fixing portion 2 and the abutment member 3 is provided, but two or more sets of them may be provided in different portions.

Figure 2:
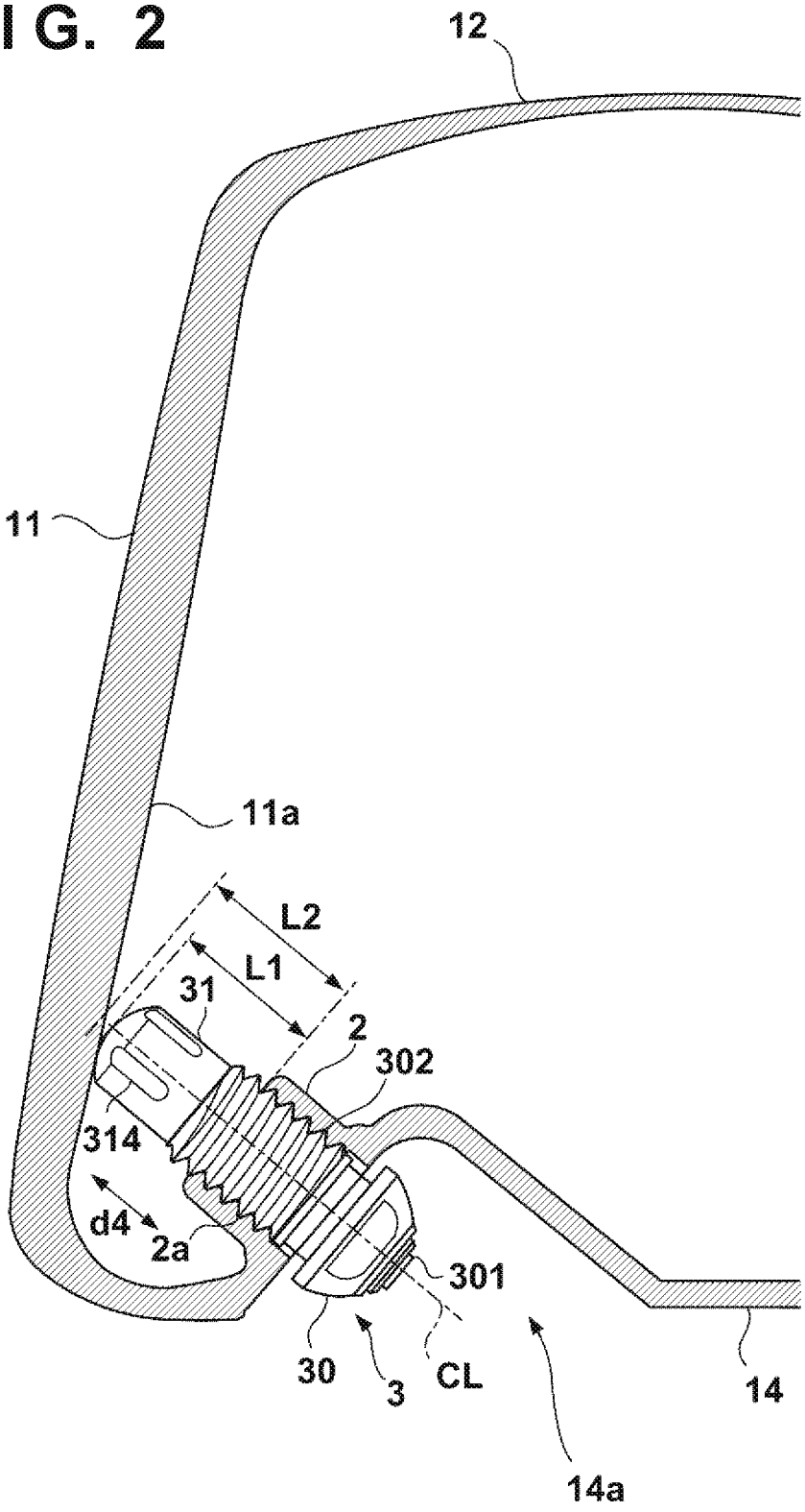
FIG. 2 is a sectional view taken along a line X-X in FIG. 1B.

The fixing portion 2 and the abutment member 3 will be further described. FIG. 2 is a sectional view taken along a line X-X in FIG. 1B, and the positional relationship between the head body, the fixing portion 2, and the abutment member 3 with respect to the central axis line of the abutment member 3 is shown in a sectional view. Note that the view is rotated such that the crown portion 12 is located on the upper side in FIG. 2, so that it is a sectional view when viewed from the heel side.

In this embodiment, the abutment member 3 is a shaft-shaped member that extends in a d4 direction and abuts against a back surface 11*a* of the face portion 11. The abutment member 3 is a cylindrical member in this embodiment, but it may be a member having another shape such as a prismatic shape. The d4 direction is a direction obliquely upward from the back side toward the face portion 11 side in the d1 direction. The abutment member 3 abuts against the back surface 11*a* at the lower portion of the face portion 11, and particularly below the face center. Since the abutment member 3 abuts against the lower portion (the sole portion 14 side) of the face portion 11, the deformation of the lower portion of the face portion 14 is constrained more than the upper portion. This contributes to an increase in launch angle of a ball at the time of striking the ball. Note that the face center can be specified by, for example, an impact point template used when measuring the CT value of the face portion.

In this embodiment, a central axis line CL of the abutment member 3 is not parallel to but intersects with the normal direction of the back surface 11*a*. By making the abutment member 3 obliquely abut against the back surface 11*a* of the face portion 11, it can be prevented that a stress larger than necessary concentrates on the abutment member 3, the fixing portion 2, or the abutted portion of the face portion 11 at the time of striking a ball.

The abutment member 3 includes a non-metal distal end portion 31 that abuts against the back surface 11*a* of the face portion 11 and a metal body portion 30 that is fixed to the fixing portion 2. Examples of a non-metal material which forms the distal end portion 31 are, for example, a resin, rubber, and FRP. Examples of a metal material which forms the body portion 30 are, for example, aluminum, magnesium, titanium, iron, and tungsten. By using a metal member as the body portion 30 fixed to the fixing portion 2, a higher strength can be obtained as the fixing strength of the abutment member 3 to the fixing portion 2, so that the durability to impact at the time of striking a ball can be increased. On the other hand, by using a non-metal member as the distal end portion 31 abutting against the back surface 11*a*, it is possible to appropriately constrain the face portion 11 without extremely constraining the bending of the face portion 11 at the time of striking a ball.

In this embodiment, the fixing structure of the body portion 30 by the fixing portion 2 is a screw structure, in which a screw hole 2*a* in the d4 direction is formed in the fixing portion 2, and the body portion 30 includes a screw shaft 302 which is screwed into the screw hole 2*a*. Note that the fixing structure is not limited to the screw structure, and may be another fixing structure such as press fitting, adhesion, welding, caulking, or the like.

The fixing portion 2 of this embodiment can adjust the fixed position of the abutment member 3 in the direction (d4 direction) from the fixing portion 2 toward the face portion 11. That is, the extension length (protrusion amount) of the abutment member 3 from the end face of the fixing portion 2 on the face portion 11 side to the face portion 11 changes depending on the screwing amount of the screw shaft 302 into the screw hole 2*a*. In this embodiment, a separation distance L1 between the end face of the fixing portion 2 on the face portion 11 side and the face portion 11 has a relationship expressed by L2>L1 with respect to a maximum extension length L2 of the abutment member 3. Even if there are individual differences of the abutment member 3 and the fixing portion 2, it is possible to make the abutment member 3 reliably abut against the back surface 11*a* by adjusting the screwing amount of the screw shaft 302 into the screw hole 2*a*, and the degree of abutment (degree of pressing) can also be adjusted. Note that the fixed position where the abutment member 3 has the maximum extension length L2 is a position where a head portion 301 of the abutment member 3 abuts against the end face of the fixing portion 2 on the back side.

Figure 3:
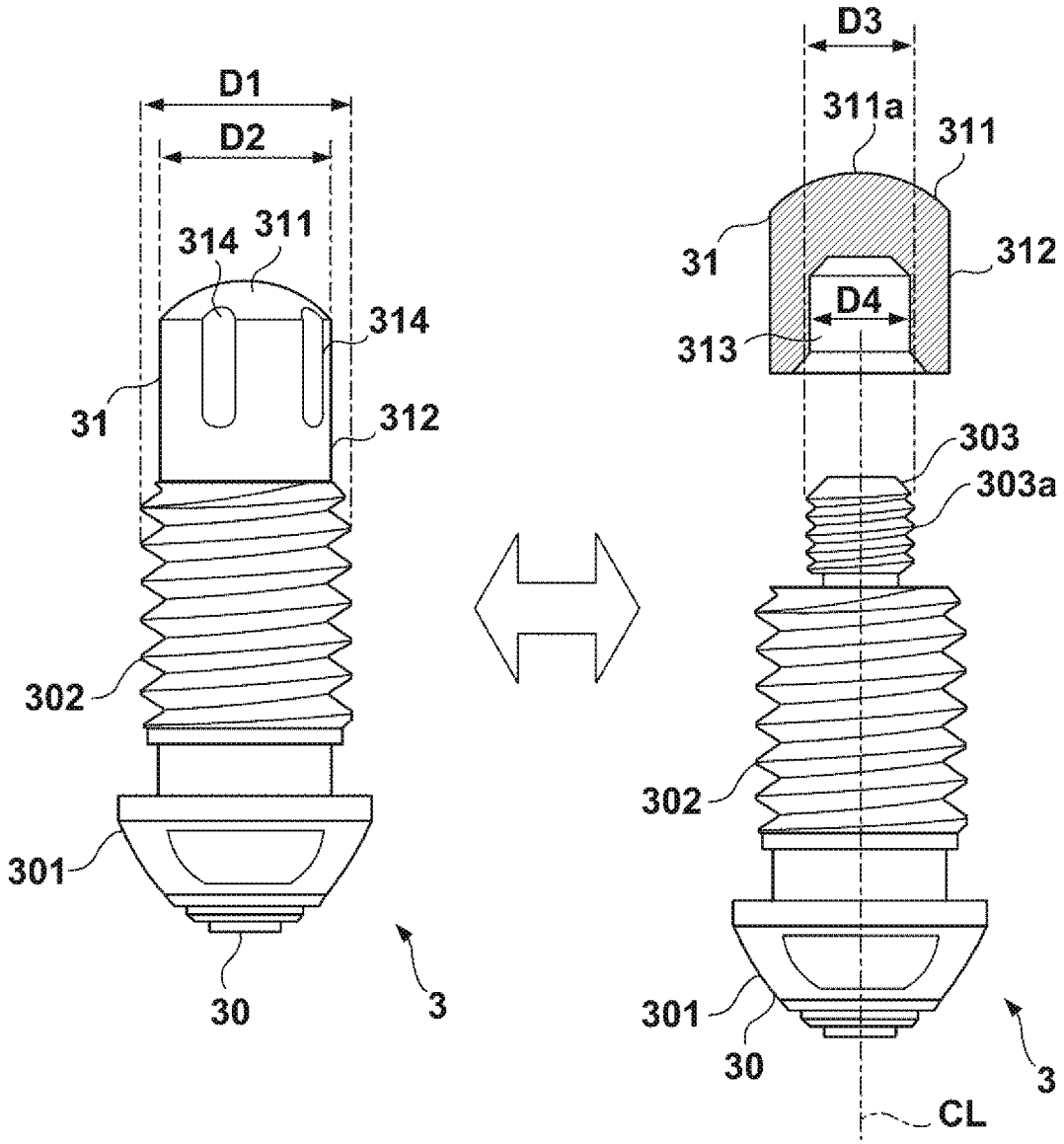
FIG. 3 shows an assembly view and an exploded view of an abutment member.
Figure 4:
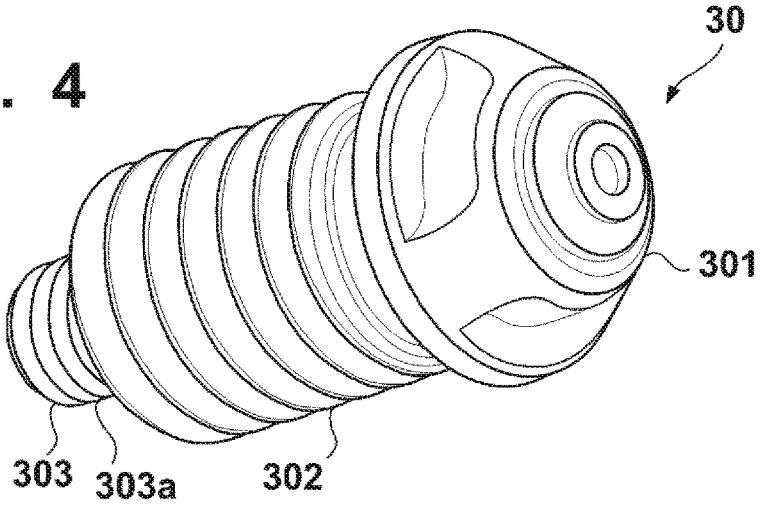
FIG. 4 is a perspective view of a body portion.
Figure 5A:
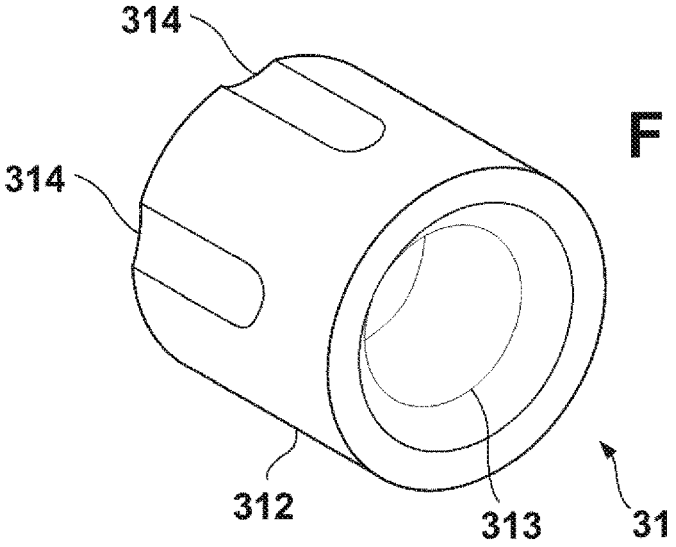
FIGS. 5A and 5B are perspective views of a distal end portion when viewed from different directions.
Figure 5B:
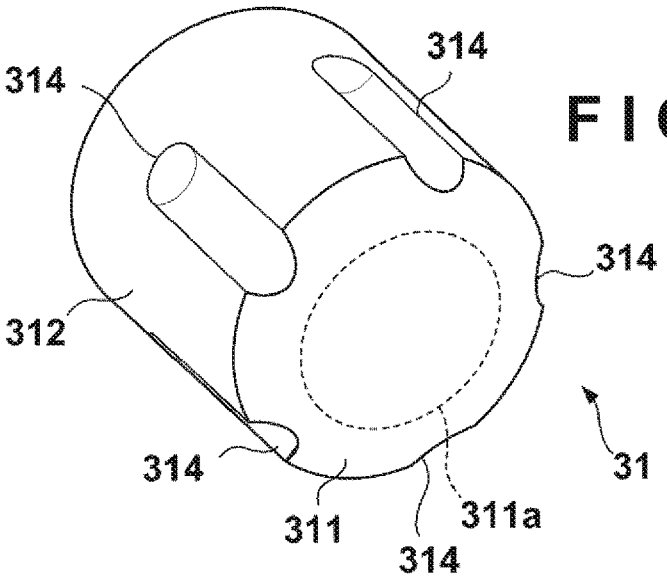

The abutment member 3 will be described with reference to FIGS. 3 to 5B. FIG. 3 shows an assembly view and an exploded view of the abutment member 3. In the exploded view, the distal end portion 31 is shown in a sectional view. FIG. 4 is a perspective view of the body portion 30. FIGS. 5A and 5B are perspective views of the distal end portion 31 when viewed from different directions.

The body portion 30 is a shaft-shaped integral part including the head portion 301, a screw shaft 302, and a convex engaging portion 303. The head portion 301 is provided at one end of the screw shaft 302, and the convex engaging portion 303 is provided at the other end of the screw shaft 302. The convex engaging portion 303 is a cylindrical body located on the central axis line CL and provided in the end portion of the body portion 30. The distal end portion 31 is a cap-like member that engages with the convex engaging portion 303. The distal end portion 31 has a cylindrical shape in this embodiment, but it may have another outer shape such as a rectangular cylindrical shape.

The distal end portion 31 includes a distal end face 311 that abuts against the back surface 11*a*, a concave engaging portion 313 opened in the end face opposite to the distal end face 311, and an outer peripheral surface 312. The concave engaging portion 313 is a bottomed hole which is located on the central axis line CL and has a circular sectional shape. The body portion 30 and the distal end portion 31 are coupled to each other by fitting the convex engaging portion 303 in and engaging with the concave engaging portion 313. At the time of striking a ball, an impact acts on the engagement portion between the body portion 30 and the distal end portion 31 and a stress may concentrate thereon.

In this embodiment, the metal engaging portion on the body portion 30 side has a convex shape, and the non-metal engaging portion on the distal end portion 31 side has a concave shape. This can improve the rigidity of the coupling portion between the body portion 30 and the distal end portion 31 as compared with a reverse arrangement (that is, the distal end portion 31 includes a convex engaging portion and the body portion 30 includes a concave engaging portion), so that the breakage thereof can be prevented.

In this embodiment, in a state in which the body portion 30 and the distal end portion 31 are separated from each other, the relationship between an outer diameter D3 of the convex engaging portion 303 and an inner diameter D4 of the concave engaging portion 313 is expressed by D3>D4. As a result, the convex engaging portion 303 and the concave engaging portion 313 are fitted in interference fitting and a higher coupling force can be obtained. In this embodiment, a non-slip portion 303*a* is formed on the outer peripheral surface of the convex engaging portion 303 to improve the coupling force between the convex engaging portion 303 and the concave engaging portion 313. In this embodiment, the non-slip portion 303*a* is a spirally formed uneven surface (screw). However, another non-slip shape such as annular grooves or randomly formed protrusions may also be used. The non-slip portion 303*a* may be provided on the inner peripheral surface of the concave engaging portion 313, or may be provided on each of the outer peripheral surface of the convex engaging portion 302 and the inner peripheral surface of the concave engaging portion 313.

In this embodiment, in a portion of the body portion 30 from the portion fixed to the fixing portion 2 to the convex engaging portion 303, the relationship between an outer diameter D1 of the screw shaft 302 and an outer diameter D2 of the distal end portion 31 is expressed by D1>D2. As a result, the entire end face of the distal end portion 31 on the body portion 30 side abuts against the end face of the screw shaft 302 on the distal end portion 31 side, so that the impact in the direction of the central axis line CL that the distal end portion 31 receives from the face portion 11 at the time of striking a ball can be received by the body portion 30.

The distal end portion 31 includes the distal end face 311 that abuts against the back surface 11*a* of the face portion 11. In this embodiment, the distal end face 311 is a curved surface, and particularly has a spherical shape. Since the distal end face 311 is the curved surface, the abutment against the back surface 11*a* can be made more uniform regardless of the individual difference of the abutment member 3. Further, the abutment member 3 can prevent unnecessary constraint of the deformation of the face portion 11 at the time of striking a ball.

In this embodiment, the distal end face 311 abuts against the back surface 11*a* of the face portion 11 at least on a virtual extended region 311*a* of the convex engaging portion 303 in the axial direction. The d4-direction component force of an impact acting on the face portion 11 at the time of striking a ball can be reliably transmitted to the body portion 30, so that the deformation of the face portion 11 in the d4 direction can be suppressed.

A plurality of grooves 314 circumferentially spaced apart from each other are formed on the outer surface of the distal end portion 31. The groove 314 is a groove extending in the axial direction of the abutment member 3. By forming such grooves 314, weight reduction of the distal end portion 31 can be achieved. When the groove 314 is positioned at the contact portion between the abutment member 3 and the back surface 11*a* of the face portion 11, the area of the contact portion decreases as compared with a case without the groove 314. Therefore, it is possible to change how the abutment member 3 abuts against the back surface 11*a*. In addition, if the abutment member 3 is a user-replaceable part, the design seen by a user can be improved.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

What is claimed is:

1. A golf club head that includes a face portion, comprising:

an abutment member which abuts against a back surface of the face portion; and a fixing portion which is provided at a position separated from the back surface of the face portion and to which the abutment member is fixed, the abutment member including;

a non-metal distal end portion which abuts against the back surface of the face portion; and a metal body portion which is fixed to the fixing portion, the body portion including a convex engaging portion provided in an end portion of the body portion, the distal end portion including a concave engaging portion which engages with the convex engaging portion, wherein the abutment member is a cylindrical member, the convex engaging portion and the concave engaging portion are located on a central axis line of the abutment member, a non-slip portion is formed on an outer peripheral surface of the convex engaging portion, and the non-slip portion is a spirally formed uneven surface.

2. The golf club head according to claim 1, wherein the distal end portion has a first outer diameter, and a portion of the body portion from a portion fixed to the fixing portion to the convex engaging portion in the body portion has a second outer diameter larger than the first outer diameter.

3. The golf club head according to claim 1, wherein the fixing portion can adjust a fixed position of the abutment member in a direction from the fixing portion toward the face portion, when the fixed position is at a predetermined fixed position, an extension length of the abutment member from the fixing portion to the face portion is maximum, and the maximum extension length is larger than a separation distance between the fixing portion and the face portion.

4. The golf club head according to claim 1, wherein the concave engaging portion is a concave portion having a circular section, and in a state in which the convex engaging portion and the concave engaging portion are disengaged from each other, an outer diameter of the convex engaging portion is larger than an inner diameter of the concave engaging portion.

5. The golf club head according to claim 1, wherein the distal end portion includes a distal end face, and the distal end face is a curved distal end face.

* * * * *